United States Patent [19]

Welch

[11] Patent Number: 4,997,038

[45] Date of Patent: Mar. 5, 1991

[54] LOCK MANDREL LATCH ASSEMBLY

[75] Inventor: William R. Welch, Carrollton, Tex.

[73] Assignee: Otis Engineering Corporation, Carrollton, Tex.

[21] Appl. No.: 441,826

[22] Filed: Nov. 27, 1989

Related U.S. Application Data

[63] Continuation-in-part of Ser. No. 316,670, Feb. 28, 1989, Pat. No. 4,962,813.

[51] Int. Cl.[5] ..... E21B 23/02

[52] U.S. Cl. ..... 166/214; 166/217

[58] Field of Search ..... 166/362, 212, 215, 216, 166/217, 206, 207, 214

[56] References Cited

U.S. PATENT DOCUMENTS 3,382,929 5/1968 Plunk ..... 166/214 X 3,504,743 4/1970 Winters ..... 166/214 X

FOREIGN PATENT DOCUMENTS 817712 7/1969 Canada ..... 166/214

*Primary Examiner*—William P. Neuder

*Attorney, Agent, or Firm*—Ross, Howison, Clapp & Korn

[57] ABSTRACT

A well tool locking assembly comprising a lock mandrel having locking keys adapted to releasably engage a locking annulus within a well bore, and a latch assembly adapted to maintain the lock mandrel in a desired positional relation to the locking annulus until such time as the locking keys engage the locking annulus; the latch assembly further comprising at least one rotatably mounted, outwardly biased pawl adapted to engage the locking annulus, and a shear pin disposed below the pawl, the pawl being adapted to rotate downwardly into contact with the shear pin whenever the pawl is forced into contact with the upper portion of the locking annulus, the shear pin being further adapted to shear whenever the force exerted on it by the pawl exceeds a predetermined maximum.

18 Claims, 4 Drawing Sheets

LOCK MANDREL LATCH ASSEMBLY

CROSS-REFERENCE TO RELATED APPLICATION

This application is a continuation-in-part of U.S. Ser. No. 316,670 filed Feb. 28, 1989 now U.S. Pat. No. 4,962,813.

BACKGROUND OF THE INVENTION

1. Field of the Invention

This invention relates to well tool locking systems suitable for use with wireline tool strings. One aspect of the invention relates to apparatus for releasably locking a well tool such as a surface-controlled subsurface safety valve (SCSSV) in a staggered well bore. Another aspect of the invention relates to a latch assembly for use in preliminarily latching a lock mandrel inside a flow conductor in a staggered well bore.

2. Description of the Prior Art

Lock mandrels useful for releasably locking other well tools such as a wireline-retrievable SCSSV inside a flow conductor are well known. Such lock mandrels have previously been disclosed, for example, in U.S. Pat. Nos. 4,545,434 and 4,745,974. These patents teach the use of a running tool in a wireline tool string for driving a lock mandrel having a SCSSV connected to it into a landing nipple disposed in the flow conductor of a well.

The safety valve and lock mandrel are driven downwardly into the landing nipple until a fixed no-go ring on the outer surface of the lock mandrel contacts an opposing no-go shoulder in the landing nipple. The running tool is not releasable from the lock mandrel until the SCSSV has been pressured open and the locking keys have engaged the locking annulus of the landing nipple. The locking keys in the lock mandrel are engaged by jarring upwardly on the running tool. An alternative locking system is disclosed in U.S. Pat. No. 4,844,159.

Although the locking systems disclosed in U.S. Pat. Nos. 4,545,434 and 4,745,974 possess significant advantages when compared to the conventional locking systems previously known, problems have been encountered in using those locking systems when the well bore is staggered or graduated between the landing nipple and that section of the bore in which the SCSSV is set. In such situations, the control line pressure exerted to pump the safety valve open during the locking process instead forces the lock mandrel and valve assembly upward before the lock mandrel locking keys can be set due to the area differential in the two sections of the staggered bore.

In U.S. Pat. No. 4,962,813 [application Ser. No. 316,670], incorporated by reference herein, apparatus is disclosed for prepropping the locking keys into the locking annulus of the landing nipple prior to applying control line pressure to the SCSSV. With the locking keys prepropped in this manner, they are prevented from being forced upward out of alignment with the locking annulus of the landing nipple when control line pressure is applied to the SCSSV in a staggered bore. Once the SCSSV is pressured open, the core of the running tool drops and the running tool is jarred upward, causing the locking keys to fully engage the locking annulus. The running tool is then released from the lock mandrel, and can be withdrawn from the well bore.

Notwithstanding the advantages achieved by use of the apparatus disclosed in U.S. Pat. No. 4,962,813 [application Ser. No. 316,670], however, operational considerations suggest that alternative means may be even more desirable for securing the lock mandrel in its preferred alignment with the locking annulus of the landing nipple until the SCSSV is activated and the locking keys are fully engaged.

SUMMARY OF THE INVENTION

According to the present invention, a well tool locking system is provided that comprises novel means for holding a lock mandrel in its preferred alignment with a landing nipple inside a flow conductor until the locking keys of the lock mandrel are fully engaged.

According to one embodiment of the invention, a well tool locking system is provided that comprises means for preliminarily latching a lock mandrel to a landing nipple in a staggered well bore.

According to another embodiment of the invention, means are provided for locking a SCSSV in a staggered well bore, comprising a latch assembly adapted to hold a lock mandrel to which the SCSSV is attached in its preferred positional alignment with a landing nipple while the SCSSV is activated and while the locking keys of the lock mandrel are fully expanded.

According to another embodiment of the invention, a well tool locking system is provided that comprises a latch assembly adapted to automatically engage a locking annulus in a flow conductor when a lock mandrel and a well tool such as a SCSSV are driven into engagement with a landing nipple. The subject latch assembly preferably further comprises means for releasing the latch assembly from the locking annulus to permit withdrawal of the lock mandrel from the flow conductor following disengagement of the lock mandrel locking keys from the landing nipple.

According to another embodiment of the invention, a well tool locking assembly is provided that comprises a lock mandrel having locking keys adapted to releasably engage a locking annulus within a well bore, and a latch assembly adapted to maintain the lock mandrel in a desired positional relation to the locking annulus until such time as the locking keys engage the locking annulus; the latch assembly further comprising at least one rotatably mounted, outwardly biased pawl adapted to engage the locking annulus, and a shear pin disposed below the pawl, the pawl being adapted to rotate downwardly into contact with the shear pin whenever the pawl is forced into contact with the upper portion of the locking annulus, the shear pin being further adapted to shear whenever the force exerted on it by the pawl exceeds a predetermined maximum.

According to another embodiment of the invention, a latch assembly is provided that comprises at least one pawl rotatably mounted on a wrist pin traversing a window in the sidewall of a lock mandrel, a shear pin traversing the window in the sidewall of the lock mandrel below the pawl, and a spring biasing the pawl against the shear pin, the pawl being thereby adapted to extend radially outward beyond the circumference of the sidewall of the lock mandrel to engage an annular recess in a well bore. Once the load exerted by the pawl against the shear pin has exceeded a predetermined maximum and the pin is sheared, the pawl is preferably adapted to rotate downwardly into the lower portion of the window in the sidewall of the lock mandrel, thereby avoiding further contact with the annular recess in the well bore.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 1:
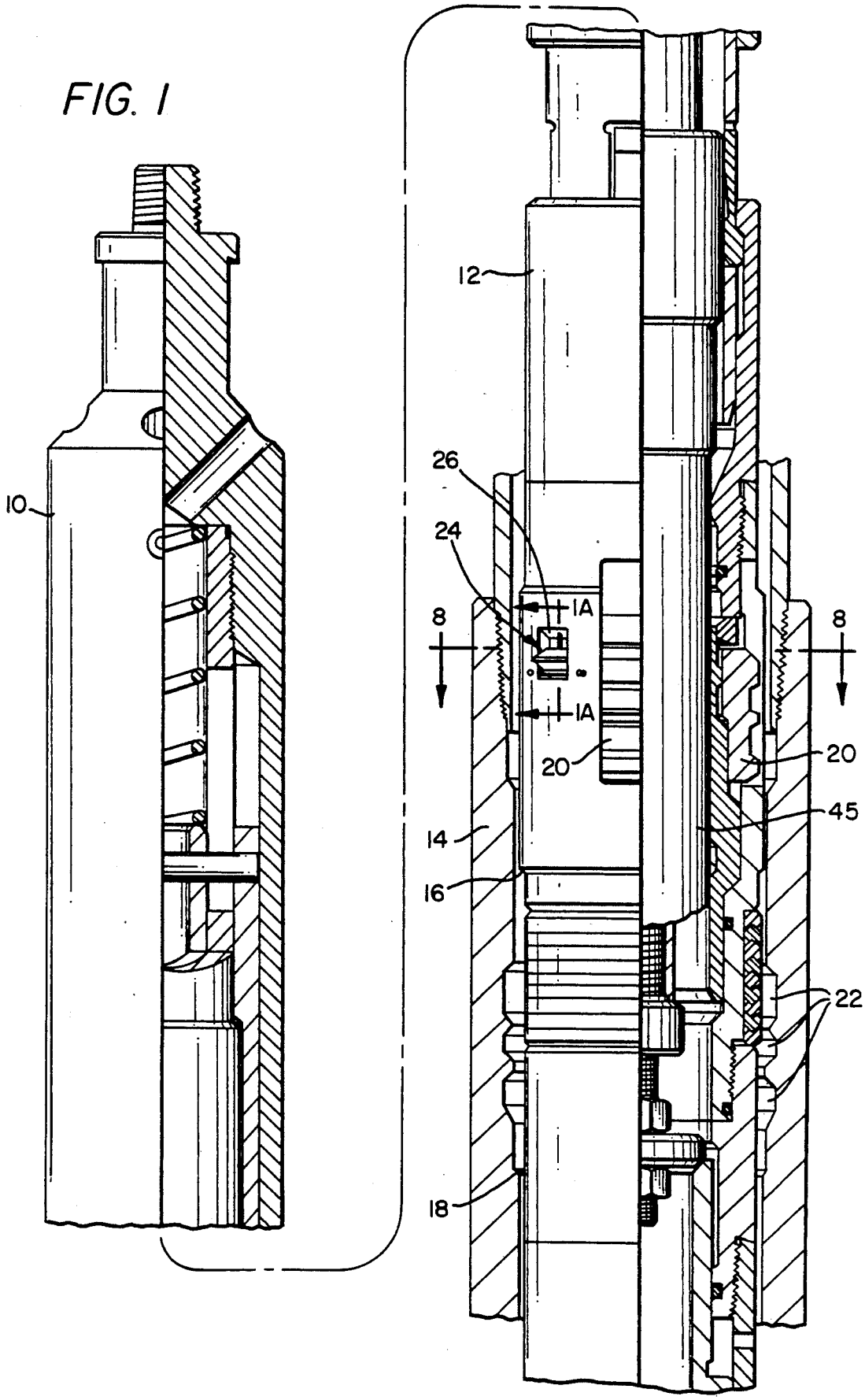
FIG. 1 is an elevation view, partially in section and partially broken away, depicting a running tool lowering a lock mandrel comprising the latch assembly of the invention into engagement with a landing nipple.

Referring to FIG. 1, running tool 10 and lock mandrel 12 are shown being run into landing nipple 14. To simplify the illustration, portions of the wireline tool string above the running tool, portions of the production tubing above and below the landing nipple, and the SCSSV below the lock mandrel have been broken away. Those elements are further shown, described and explained, however, in U.S. Pat. No. 4,962,813 [application Ser. No. 316,670].

Lock mandrel 12 comprises no-go shoulder 16, which is adapted to stop the descent of the tool string into the flow conductor when it comes into abutting contact with cooperating no-go shoulder 18 of landing nipple 14. Locking keys 20, circumferentially spaced around lock mandrel 12, are adapted to engage locking annulus 22 of landing nipple 14 after no-go shoulder 16 contacts no-go shoulder 18. As will be described in more detail below in relation to a preferred embodiment of the invention, locking keys 20 engage locking annulus 22 only after control line pressure is applied to the SCSSV and the tool string is upwardly jarred.

Figure 8:
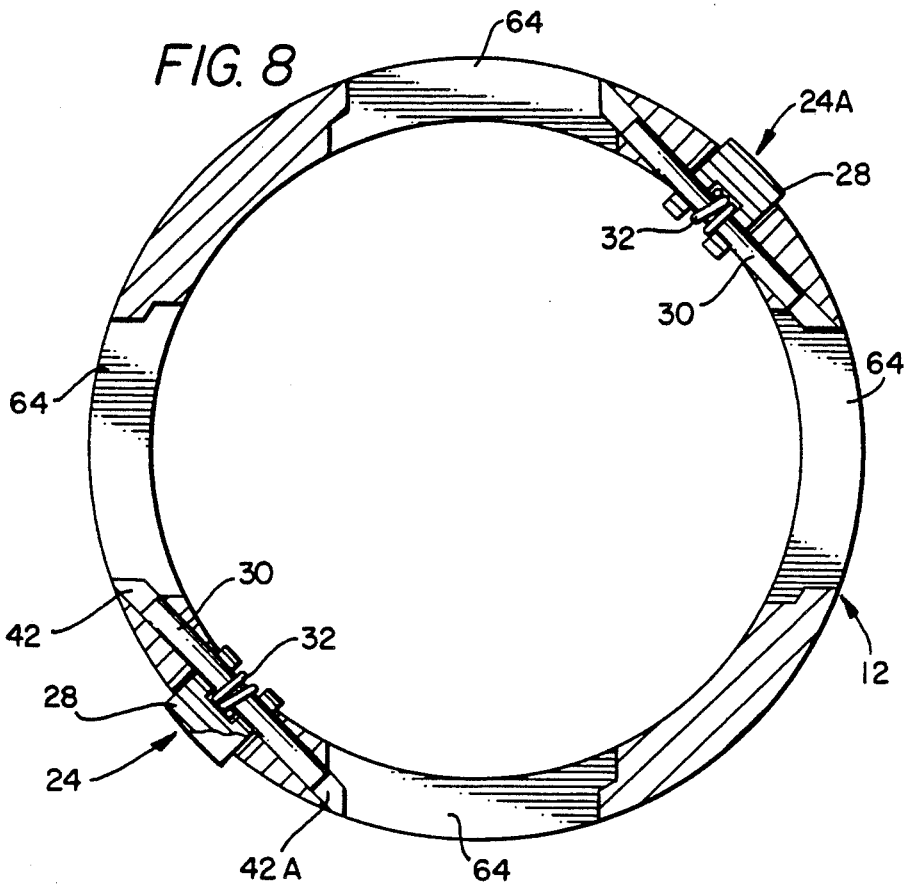
FIG. 8 is a cross-sectional plan view, partially broken away, of the side wall of the lock mandrel taken along line 8—8 of FIG. 1, depicting two diametrically opposed latch assemblies of the invention, further showing the wrist pin supporting the pawl and torsion spring of the subject latch assemblies as installed in the side wall of the lock mandrel.
Figure 8A:
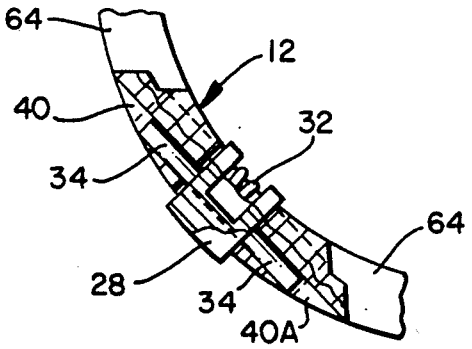
FIG. 8A is a broken-away portion of FIG. 8, depicting one latch assembly which is further broken away to show the shear pin disposed beneath the pawl in the side wall of the lock mandrel.

According to the present invention, lock mandrel 12 further comprises at least one latch assembly 24 disposed in window 26 a sufficient distance above no-go shoulder 16 that latch assembly 24 lies adjacent the top recess of locking annulus 22 whenever no-go shoulder 16 is seated against no-go shoulder 18 of landing nipple 14 as described in relation to FIG. 2B below. According to a preferred embodiment of the invention, lock mandrel 12 comprises two diametrically opposed latch assemblies 24, 24A disposed between locking key windows 64 as shown in FIG. 8, and it will be appreciated upon reading this disclosure that additional latch assemblies can be similarly utilized within the scope of the invention if desired.

Figure 1A:
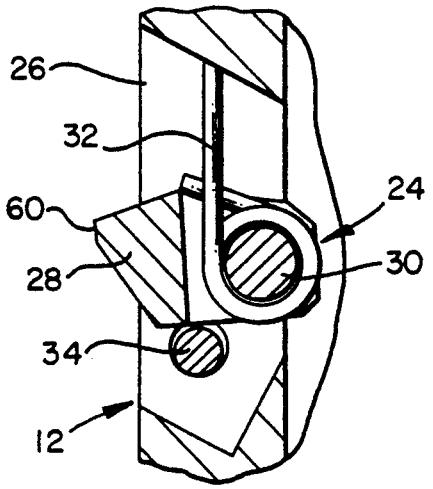
FIG. 1A is a detail sectional elevation view through the side wall of the lock mandrel taken along line 1A—1A of FIG. 1.
Figure 7:
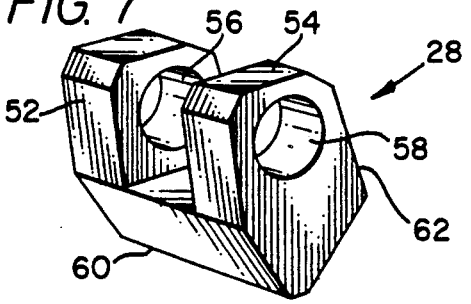
FIG. 7 is an enlarged perspective view of the rear of the pawl.

Referring to FIG. 1A, latch assembly 24 of the invention preferably further comprises pawl 28, wrist pin 30, torsion spring 32 and shear pin 34. As shown in FIG. 7, pawl 28 further comprises spaced-apart support arms 52, 54 having coaxially aligned cylindrical bores 56, 58, respectively. The diameter of cylindrical bores 56, 58 is desirably slightly greater than the diameter of wrist pin 30 to insure that pawl 28 can rotate around wrist pin 30.

Figure 2:
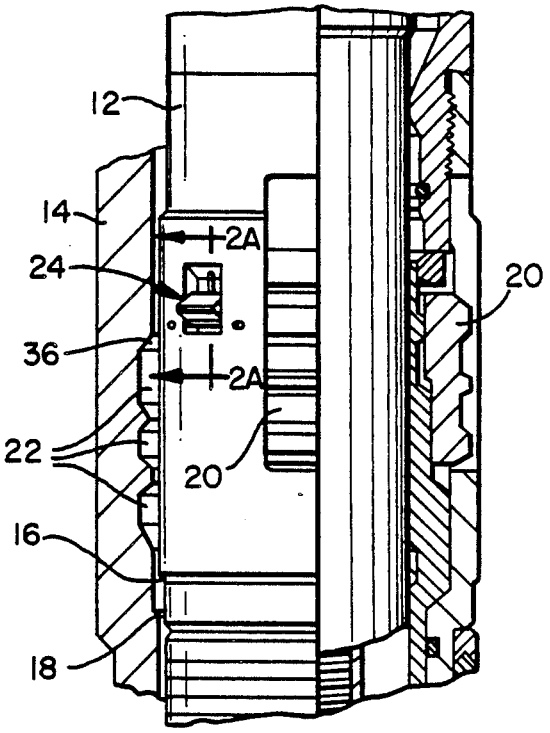
FIG. 2 is a detail elevation view, partially in section and partially broken away, depicting the lock mandrel as the pawl approaches the locking annulus in the landing nipple.
Figure 2A:
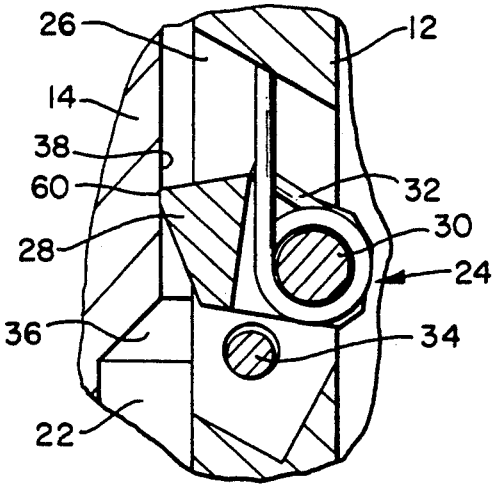
FIG. 2A is a detail sectional elevation view through the side wall of the lock mandrel and the landing nipple taken along line 2A—2A of FIG. 2, showing the pawl being biased by the torsion spring against the inside wall of the landing nipple.

Referring to FIGS. 1A, 6, 7, 8 and 8A, pawl 28 is supported in window 26 of lock mandrel 12 by wrist pin 30, which is inserted into coaxially aligned cylindrical bores 42, 42A and extends transversely across window 26. The diameters of wrist pin 30 and bores 42, 42A will desirably be such that an interference fit is maintained between wrist pin 30 and bores 42, 42A. (A looser fit is shown in FIGS. 1A, 2A, 2B and 3A for purposes of illustration only.) Wrist pin 30 will desirably be adapted to withstand a design load significantly greater than that of shear pin 34 in order that wrist pin 30 will not fail during locking, unlocking or removal of lock mandrel 12. Torsion spring 32 is preferably sized and configured so that it will fit between support arms 52, 54 of pawl 28, and will be maintained in that position by that portion of wrist pin 30 which extends between support arms 52, 54 of pawl 28. As shown in FIGS. 1A and 2A, torsion spring 32 is preferably configured and oriented so that pawl 28 is biased radially outward from the remainder of lock mandrel 12 and downward from the top of window 26. Shear pin 34 is inserted into coaxially aligned cylindrical bores 40, 40A and extends transversely across window 26 below pawl 28. The diameters of shear pin 34 and bores 40, 40A will desirably be such that an interference fit is maintained between shear pin 34 and bores 40, 40A. (Here again, a looser fit is shown in FIGS. 1A, 2A, 2B and 3A for purposes of illustration only.)

Referring to FIGS. 1A and 2A, torsion spring 32 is preferably configured and oriented so that pawl 28 is biased radially outwardly from the remainder of lock mandrel 12 and downwardly from the top of window 26. Referring to FIGS. 2 and 2A, as lock mandrel 12 moves down through the production tubing and into the landing nipple 14, pawl 28 of latch assembly 24 is forced outwardly from window 26 by torsion spring 30. Pawl 28 is preferably designed and supported in window 26 in such manner that when pawl 28 biased downwardly against shear pin 34 by torsion spring 32, leading edge 60 extends outwardly beyond the outside wall of lock mandrel 12 a distance greater than the width of the annular space between the outside wall of lock mandrel 12 and the inside wall of landing nipple 14 above locking annulus 22. If a restriction or minor obstruction is encountered along the inside wall of the production tubing or landing nipple as the tool string moves downwardly through the well, pawl 28 will be rotated upwardly against the bias of torsion spring 32, and will pass over the restriction or obstruction. As shown in FIG. 2A, leading edge 60 of pawl 28 is sliding along the inside wall of landing nipple 14. Because leading edge 60 of pawl 28 is contacting the inside wall of landing nipple 14, leading edge 60 is prevented from being rotated downward by torsion spring 32 against shear pin 34.

Figure 2B:
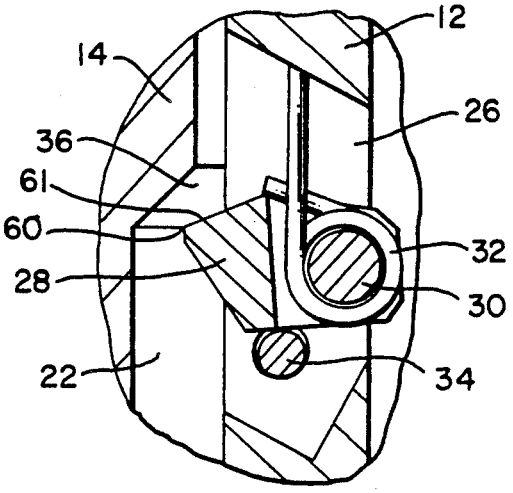
FIG. 2B is a detail sectional elevation view as in FIG. 2A after the lock mandrel has been lowered to the point where the no-go locating shoulder of the landing nipple is contacted, the pawl is aligned with the locking annulus of the landing nipple, and the pawl is biased outwardly into the locking annulus and downwardly against the shear pin disposed below it.
Figure 3:
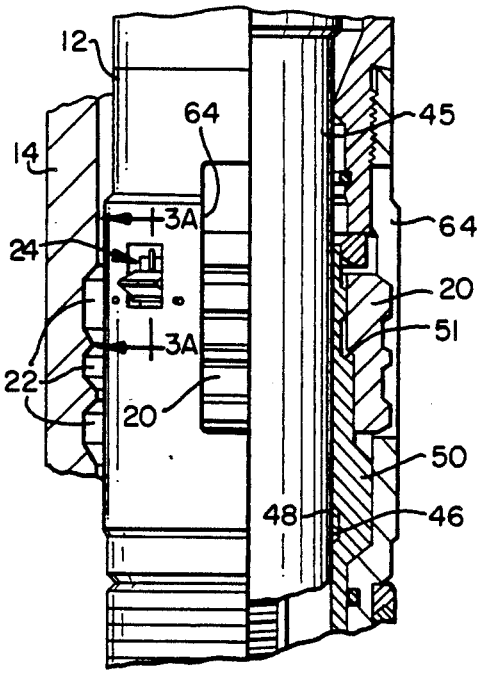
FIG. 3 is a detail elevation view, partially in section and partially broken away, depicting the lock mandrel in the position where it is being pressured upward by hydraulic force applied to the SCSSV (not shown) prior to engaging the locking keys in the locking annulus, and the pawl is contacting the top shoulder of the locking annulus to limit further upward movement of the lock mandrel in the well bore.

When no-go shoulder 16 of lock mandrel 12 contacts no-go shoulder 18 of landing nipple 14 as discussed above in relation to FIG. 1, pawl 28 is desirably opposite the upper portion of locking annulus 22 of landing nipple 14 as shown in FIG. 2B. Similarly locking keys 20 of lock mandrel 12 are opposite locking annulus 22 of landing nipple 14 as shown in FIG. 3. The increased internal diameter of landing nipple 14 at that point permits torsion spring 32 to rotate pawl 28 downwardly against shear pin 34.

After no-go shoulder 16 contacts no-go shoulder 18 and the downward motion of lock mandrel 12 is thereby stopped. As shown in FIG. 3, locking keys 20 are still disposed inside windows 64 of lock mandrel 12 since no prepropping of locking keys 20 has occurred This feature of the present invention is contrary to that disclosed in U.S. Pat. No. 4,962,813, wherein the locking keys are prepropped into the locking annulus of the landing nipple by the action of the slidable no-go ring of the lock mandrel against the locking sleeve Hydraulic pressure is then applied through a control line to the SCSSV, pressuring open the valve as described in U.S. Pat. No. 4,962,813. This causes the core of running tool 10 (inside lower setting sleeve 45 and not visible in FIG. 3) to engage lower setting sleeve 45 of lock mandrel 12, which is already engaged with locking sleeve 50 by means of locking lug 46 disposed in annular recess 48.

Figure 3A:
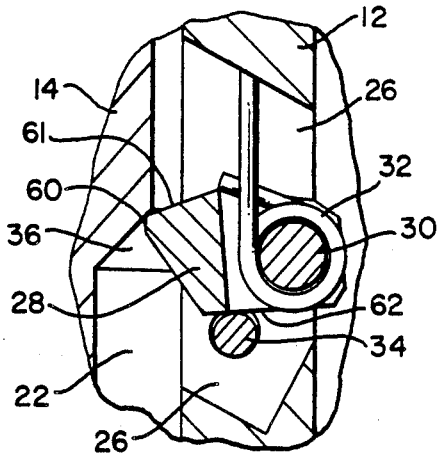
FIG. 3A is a detail sectional elevation view through the side wall of the lock mandrel and the landing nipple taken along line 3A—3A of FIG. 3, better illustrating the manner in which the pawl is contacting the top shoulder of the locking annulus to limit further upward movement of the lock mandrel in the well bore, with the bottom of the pawl resting against the shear pin to limit further downward rotation.

According to the present invention, as shown in FIG. 3A, leading edge 60 and/or top surface 61 of pawl 28 of latch assembly 24 preferably engage upper shoulder 36 of locking annulus 22. This prevents lock mandrel 12 from rising relative to landing nipple 14 due to pressure exerted from below to a point where locking keys 20 of lock mandrel 12 are no longer aligned with locking annulus 22.

Figure 4:
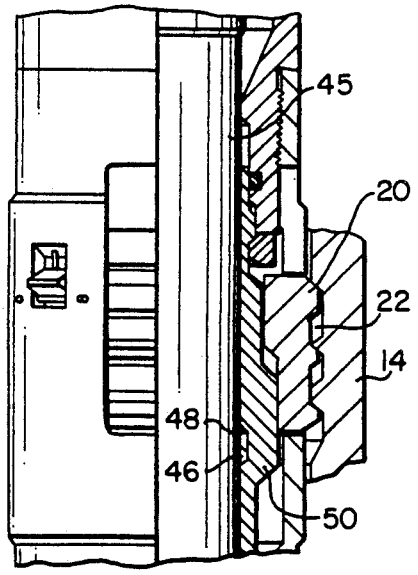
FIG. 4 is a detail elevation view, partially in section and partially broken away, depicting the lock mandrel locking keys fully engaging the locking annulus of the landing nipple.
Figure 6:
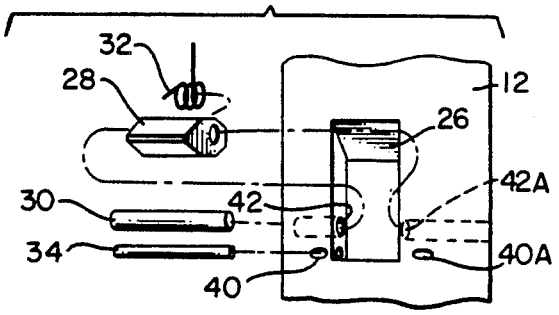
FIG. 6 is an exploded detail perspective view depicting the pawl, torsion spring, wrist pin and shear pin removed from the window in the side wall of the lock mandrel.

With latch assembly 24 maintaining the vertical alignment between lock mandrel 12 and landing nipple 14 as shown in FIG. 3A, the tool string is jarred upwards, and the upwardly directed force applied to locking sleeve 50 by lower setting sleeve 45 through locking lugs 46 causes shoulder 51 of locking sleeve 50 to drive locking keys 20 radially outward into engagement with locking annulus 22 as shown in FIG. 4. When locking keys 20 are fully propped into locking annulus 22, lock mandrel 12 is fully locked to landing nipple 14, and running tool 10 is released from lower setting sleeve 45, and can be withdrawn from the well. It will be appreciated that the upward pressure required to engage locking keys 20 will desirably be less than the design load of shear pin 34.

Figure 5:
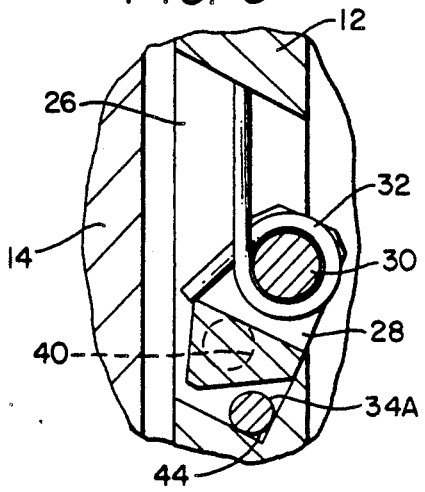
FIG. 5 is a detail sectional elevation view through the side wall of the lock mandrel and a portion of the landing nipple, depicting the pawl rotated downwardly inside the window in the lock mandrel after the shear pin is sheared.

If difficulties are encountered which make it impossible to engage locking keys 20 and release running tool 10 after no-go shoulder 16 has contacted no-go shoulder 18, latch assembly 24 can be disengaged from locking annulus 22 by overpressuring pawl 28, causing shear pin 34 to break. In that situation, as shown in FIG. 5, sheared section 34A of shear pin 34 drops into trough 44 at the bottom of window 26, and torsion spring 32 causes pawl 28 to pivot downwardly into the lower portion of window 26, where it will no longer interfere with the withdrawal of lock mandrel 12 from landing nipple 14.

Shear pin 34 will likewise be intentionally sheared when it is desired to disengage lock mandrel 12 from landing nipple 14 for removal of the SCSSV or other well tool from the well bore after successful operation of the SCSSV. In this situation, a pulling tool (not shown, but described in U.S. Pat. No. 4,962,813) is lowered into engagement with lock mandrel 12, and is thereafter operated to disengage locking keys 20 from locking annulus 22 of landing nipple 14. Once locking keys 20 are disengaged, the only structural element preventing removal of lock mandrel 12 from landing nipple 14 is latch assembly 24. Shear pin 34 can then be sheared by pulling upwardly on the tool string from the surface, or by increasing pressure beneath latch assembly 24 to a level sufficient to break shear pin 34.

Shear pin 34 is preferably made of a material and diameter adequate to withstand the intended design load. In the context of use with a SCSSV, the design load will normally be greater than the pressure required to open the SCSSV, but less than the maximum available control line pressure. The diameter and placement of shear pin 34 relative to pawl 28 of latch assembly 24 will of course be affected by the length and configuration of pawl 28, and the placement of wrist pin 30 in window 26. Window 26 will desirably be large enough that pawl 28 can be rotated fully from an upward position to a downward position within the window.

Other alterations and modifications of the invention disclosed herein will become apparent to on of ordinary skill in the art upon reading the present disclosure, and it is intended that the scope of the invention be limited only by the broadest interpretation of the appended claims to which the inventor is legally entitled.

I claim:

1. A latch assembly for preliminarily latching a lock mandrel into a locking annulus in a landing nipple in a well bore, said latch assembly being disposed in a window in a sidewall of said lock mandrel;

said latch assembly further comprising a pawl rotatably mounted about an axis traversing said window, a shear pin traversing said window below said pawl, and means for biasing said pawl against said shear pin;

said pawl being further adapted to extend radially outward through said window in said sidewall of said lock mandrel to engage said locking annulus in said landing nipple when said pawl is biased against said shear pin.

2. The latch assembly of claim 1 wherein said pawl is adapted to rotate downwardly into said window upon failure of said shear pin.

3. The latch assembly of claim 1 wherein said pawl is rotatably mounted on a wrist pin traversing said window.

4. The latch assembly of claim 1 wherein said pawl is biased against said shear pin by a torsion spring.

5. A well tool locking assembly adapted for releasably locking a well tool in a well bore, said locking assembly comprising:

female locking means disposed in said well bore;

male locking means adapted to be lowered into vertical alignment with said female locking means radially inward from said female locking means, said well tool being operatively connected to said male locking means;

said male locking means comprising a latch assembly and locking keys;

said female locking means comprising means for receiving and engaging a portion of said latch assembly and locking keys;

said latch assembly being adapted to engage said female locking means and maintain said vertical alignment between said female locking means and said male locking means prior to engagement of said locking keys with said female locking means;

said latch assembly further comprising a pawl rotatably mounted about a transverse axis traversing a window disposed in said male locking means, a shear pin traversing said window below said pawl, and means for biasing said pawl against said shear pin;

said pawl being further adapted to extend radially outward to engage said female locking means when said pawl is biased against said shear pin.

6. The well tool locking assembly of claim 5 wherein said male locking means is a lock mandrel.

7. The well tool locking assembly of claim 5 wherein said female locking means is a landing nipple.

8. The well tool locking assembly of claim 5 wherein said pawl is adapted to rotate downwardly into said window upon failure of said shear pin.

9. The well tool locking assembly of claim 5 wherein said pawl is rotatably mounted on a wrist pin traversing said window.

10. The well tool locking assembly of claim 5 wherein said male locking means comprises circumferentially spaced locking keys and said window is disposed between said circumferentially spaced locking keys.

11. The well tool locking assembly of claim 5 wherein said pawl is biased against said shear pin by a torsion spring.

12. Apparatus for releasably locking a well tool in a well bore, said apparatus comprising at least one latch assembly adapted to hold a lock mandrel to which the well tool is attached in preferred vertical alignment with a landing nipple disposed in the well bore before locking keys in the lock mandrel engage said landing nipple;

each said latch assembly comprising at least one rotatably mounted, outwardly and downwardly biased latch means adapted to engage said landing nipple, and a shear pin disposed below said latch means, said latch means being adapted to rotate downwardly into contact with said shear pin during engagement of said latch means with said landing nipple, said shear pin being further adapted to shear whenever the force exerted on said shear pin by said latch means exceeds a predetermined maximum to permit said latch means to disengage from said landing nipple.

13. The apparatus of claim 12 wherein said latch means is a pawl.

14. The apparatus of claim 12 wherein said latch means is rotatably mounted on a wrist pin.

15. The apparatus of claim 14 wherein said latch means is biased outwardly and downwardly against said shear pin by a torsion spring supported by said wrist pin.

16. The apparatus of claim 12, comprising at least two horizontally aligned latch assemblies diametrically opposed on said lock mandrel.

17. A latch assembly for preliminarily latching a lock mandrel into a locking annulus in a landing nipple in a well bore, said latch assembly being disposed in a window in a sidewall of said lock mandrel;

said latch assembly further comprising a pawl rotatably mounted about an axis traversing said window, a shear pin traversing said window below said pawl, and means for biasing said pawl against said shear pin;

said pawl being further adapted to extend radially outward from said sidewall of said lock mandrel to engage said locking annulus in said landing nipple when said pawl is biased against said shear pin;

said lock mandrel comprising circumferentially spaced locking keys and said window being disposed between said circumferentially spaced locking keys in said lock mandrel.

18. Apparatus for releasably locking a well tool in a staggered well bore, comprising at least one latch assembly adapted to hold a lock mandrel to which the well tool is attached in preferred vertical alignment with a landing nipple disposed in the well bore before locking keys in the lock mandrel engage said landing nipple;

each said latch assembly comprising at least one rotatably mounted, outwardly and downwardly biased latch means adapted to engage said landing nipple, and a shear pin disposed below said latch means, said latch means being adapted to rotate downwardly into contact with said shear pin during engagement of said latch means with said landing nipple, said shear pin being further adapted to shear whenever the force exerted on said shear pin by said latch means exceeds a predetermined maximum;

said well tool being a surface controlled subsurface safety valve.

* * * * *